US006631678B2

(12) United States Patent
Cousin et al.

(10) Patent No.: US 6,631,678 B2
(45) Date of Patent: Oct. 14, 2003

(54) WEB INFEED DEVICE WITH DECENTRALLY ARRANGED CONNECTION STATIONS

(75) Inventors: Philippe Cousin, Montataire (FR); Jean-Claude Marmin, Estrees-Saint-Denis (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/821,966

(22) Filed: Mar. 30, 2001

(65) Prior Publication Data

US 2001/0025577 A1 Oct. 4, 2001

(30) Foreign Application Priority Data

Mar. 30, 2000 (DE) ..... 100 15 857
Oct. 27, 2000 (FR) ..... 00 13810

(51) Int. Cl.[7] ..... B41F 13/03

(52) U.S. Cl. ..... 101/228; 101/227; 226/92; 242/562.1

(58) Field of Search ..... 101/228, 227; 226/92; 242/562.1; B41F 13/03

(56) References Cited

U.S. PATENT DOCUMENTS

| | | | | |
|---|---|---|---|---|
| 2,862,705 A | * | 12/1958 | Faeber | 226/92 |
| 3,995,553 A | | 12/1976 | Winterholler et al. | 101/228 |
| 4,987,830 A | | 1/1991 | Fukuda et al. | 101/228 |
| 5,029,742 A | | 7/1991 | Theilacker et al. | 226/92 |
| 5,078,825 A | | 1/1992 | Hirabayashi | 156/361 |
| 5,320,039 A | * | 6/1994 | Reponty et al. | 101/228 |
| 5,783,029 A | * | 7/1998 | Stettner et al. | 156/510 |
| 5,944,486 A | * | 8/1999 | Hodgkins, Jr. | 416/210 R |
| 5,967,036 A | | 10/1999 | Marmin et al. | 101/219 |
| 6,038,973 A | | 3/2000 | Marmin | 101/225 |
| 6,431,508 B1 | * | 8/2002 | Courson et al. | 248/205.3 |

FOREIGN PATENT DOCUMENTS

| | | |
|---|---|---|
| DE | 2 021 246 | 12/1971 |
| DE | 2 241 127 | 3/1974 |
| DE | 43 18 299 A1 | 12/1994 |
| DE | 198 02 194 A1 | 10/1998 |
| DE | 198 16 510 A1 | 1/1999 |
| GB | 2 263 437 A | 7/1993 |

* cited by examiner

*Primary Examiner*—Leslie J. Evanisko
*Assistant Examiner*—Leo T. Hinze
(74) *Attorney, Agent, or Firm*—Laurence A. Greenberg; Werner H. Stemer; Gregory L. Mayback

(57) ABSTRACT

A device for infeeding a material web into a rotary printing machine includes an infeed element for receiving a material web start, the infeed element being introducible onto an introduction path extending at least approximately parallel to a path of the material web in the rotary printing machine. Also included are suspension stations at which the material web is connectable to the infeed element, the suspension stations being assigned to respective components of the rotary printing machine along the path of the material web through the rotary printing machine; and a web-processing rotary printing machine having a guide path for the infeed element.

16 Claims, 6 Drawing Sheets

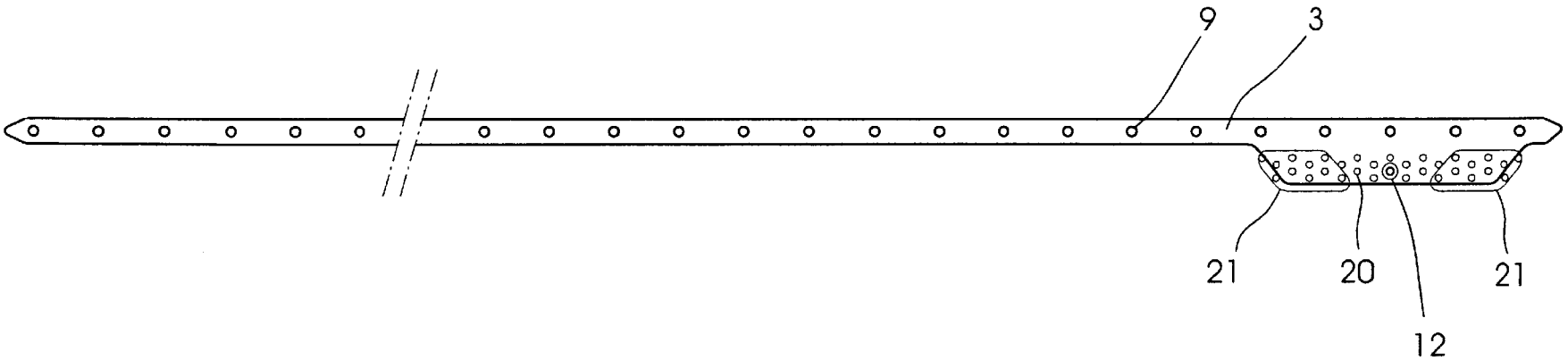
FIG. 6
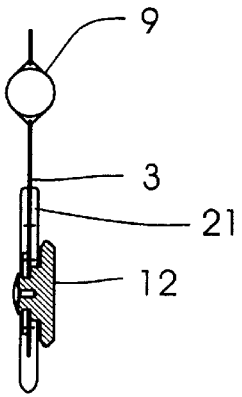
FIG. 6.1

WEB INFEED DEVICE WITH DECENTRALLY ARRANGED CONNECTION STATIONS

BACKGROUND OF THE INVENTION

Field of the Invention

The invention relates to a web infeed device with decentrally arranged connection stations, in particular, for infeeding material webs into web-processing rotary printing machines.

The published German Patent Document DE 198 02 194 A1 is concerned with a web infeed device for rotary printing machines. This device has a flexible finite infeed element, the length of which is of a somewhat greater dimension than the spacing between two adjacent driving elements. A plurality of the latter are provided for moving the infeed element in guides and switches along the infeed path for the material web to be introduced, sensors being provided along the infeed path for switching on the respectively required driving element, and for simultaneously switching off the driving element that is no longer required. The switch-on and switch-off elements are actuated by the infeed element running past. The infeed element is provided with a coating for reducing the friction in a guide.

The published German Patent Document DE 198 16 510 A1 is likewise concerned with a web infeed device for rotary printing machines. This device includes a flexible finite threading element which introduces a material web along a web path through the components of a rotary printing machine. The infeed element or elements accepting or taking up the front end of a material web have a transport device assigned thereto which passes the components of a respective rotary printing machine, such as, for example, printing units, dryers and chill-roller sections.

U.S. Pat. No. 5,029,742 shows a web threading device, in particular, for introducing a web into a rotary printing machine. In order to prevent teeth from impinging on one another in the case of a meshing worm-wheel gear, a conveying gearwheel is accepted or taken up in a movable bearing on a web infeed system for a rotary printing machine. The gearwheel is subjected to a force acting counter to the direction of movement of the infeed element and is set opposite to the conveying direction of the web infeed element. The improvement known from U.S. Pat. No. 5,029,742 is supposed to provide a web infeed station which is virtually free of wear and is supposed to make it possible for a worm-wheel gear to mesh with a transport gearwheel without excessive wear phenomena.

U.S. Pat. No. 4,987,830 shows a web infeed device for a rotary printing machine. A web infeed device for a rotary printing machine used for newsprint includes a number of guide rails which are connected to one another and are arranged along a multiplicity of web paths. An infeed element is embedded in a guide rail and can be guided along the guide rails along predetermined conveying paths for the material webs. A lever is connected at one end thereof to the web infeed element, and at the other end thereof, has a snap fastener, in order to accept or take up a paper take-up adapter which takes up the leading end of a material web stored on a roll in a web splicer of the rotary printing machine. The guide member is conveyed along the guide rails by propelled and driven wheels which are accepted or taken up along the conveying rails at uniform spaced distances from one another. The guide element has a length, which is of somewhat greater dimension than the spaced distance between adjacent guide rollers.

The devices resulting from the improvements in the state of the prior art referred to hereinbefore have the disadvantage that an infeed element serving for introducing a torn material web into components of a rotary printing machine must be moved from the initial position thereof up to the respective position at which the web tear has occurred. This involves time and effort.

SUMMARY OF THE INVENTION

It is accordingly an object of the invention, in light of the improvements heretofore known from the prior art, to reconnect a material web to a web infeed element simply and quickly, so that as rapid an introduction as possible into the components of a rotary printing machine can occur and, as a result of this, a rapid resumption of production on the rotary printing machine can take place.

With the foregoing and other objects in view, there is provided, in accordance with one aspect of the invention, a device for infeeding a material web into a rotary printing machine, comprising an infeed element for receiving a material web start, the infeed element being introducible onto an introduction path extending at least approximately parallel to a path of the material web in the rotary printing machine, and suspension stations at which the material web is connectable to the infeed element, the suspension stations being assigned to respective components of the rotary printing machine along the path of the material web through the rotary printing machine.

In accordance with another feature of the invention, the infeed element is formed of a movable part, and a suspension segment mounted respectively on one of the suspension stations.

In accordance with a further feature of the invention, the suspension stations are arranged below the path of the material web through the rotary printing machine.

In accordance with an added feature of the invention, the device includes holding devices for the suspension segments provided on the suspension stations.

In accordance with an additional feature of the invention, the holding devices are formed as magnets.

In accordance with a first alternative feature of the invention, the holding devices are formed as suction strips subjectible to a vacuum.

In accordance with a second alternative feature of the invention, the holding devices are formed as adhesive stations.

In accordance with a third alternative feature of the invention, the holding devices are formed as hook-shaped holders.

In accordance with yet another feature of the invention, the suspension segments are mountable stationarily on the holding devices.

In accordance with yet a further feature of the invention, the suspension stations include a cutting device movable transversely to the material web in a cutting gap.

In accordance with yet an added feature of the invention, the movable part of the infeed element is mounted in a parking position.

In accordance with yet an additional feature of the invention, the suspension segment mounted, respectively, on the suspension station is suspended from the movable part which is movable in the guide.

In accordance with still another feature of the invention, the movable part of the suspension element is equipped with stop faces.

In accordance with still a further feature of the invention, the movable part of the suspension element is formed of a flat and flexible metal profile.

In accordance with still an added feature of the invention, orifices conducive to the deformability of the movable part of the infeed element are formed in the movable part.

In accordance with another aspect of the invention, there is provided a material web-infeed device for a web-processing rotary printing machine, comprising an infeed element for receiving a material web start, the infeed element being introducible onto a guide path extending at least approximately parallel to a path of the material web in the rotary printing machine, and suspension stations at which the material web is connectable to the infeed element, the suspension stations being assigned to respective components of the rotary printing machine along the path of the material web through the rotary printing machine.

In accordance with a concomitant aspect of the invention, there is provided a web-processing rotary printing machine, comprising a guide path for an infeed element receiving a start of a material web, the guide path extending at least approximately parallel to a web path of the material web, and suspension stations at which the material web is connectable to the infeed element, the suspension elements being assigned to components of the rotary printing machine along the path of the material web through the rotary printing machine.

The advantages afforded by the improvement according to the invention are to be seen, above all, in that, due to the decentral arrangement of the suspension stations for an infeed element which is formed of a movable part and a plurality of stationary parts, a suspension of a material web torn during operation can take place directly at the location at which the web tear has occurred. Thus, suspension devices for introducing a material web can be provided along the web conveying path, respectively, via the components of a rotary printing machine, such as, for example, a web splicer, a web infeed unit, printing units, a web catching device, a dryer and a chill-roller section, while the movable part of the web infeed device, the movable part not being required during normal operation, can be moved into a parking position, wherein the operation of the rotary printing machine is not impaired and, on the other hand, a rapid movement of the movable part of the web infeed device can take place at the location at which a reintroduction of the material web into the components of the rotary printing machine has become necessary.

According to an advantageous development of the idea upon which the invention is based, the web infeed element is formed of a movable part and of suspension segments, respectively, mounted on the suspension stations. The movable part can be moved into a parking position when the web infeed device is in the active state, while the suspension segments cooperating, respectively, with the movable part can be kept stationary on the suspension stations, so that these segments are ready immediately, as required.

To fix the material web portions which have remained in the components of the rotary printing machine, respectively, holding devices for the material web portions are provided on the suspension stations. The holding devices may be constructed, for example, as magnets or as suction strips subjectible to a vacuum, and may extend transversely to the web running or travel direction over the suspension stations at the components, such as a web splicer, printing units, a web catching device, dryers and chill-roller sections of the rotary system. In addition to having the holding device at the suspension stations formed as magnets or as suction strips subjected to a vacuum, the suspension stations may also be formed as adhesive stations or as hook-shaped holders for the material web portions.

In a particularly advantageous embodiment of the concept upon which the invention is based, the suspension stations are mounted, respectively, below the web path of the material web through the components of the rotary system. The suspension stations have cutting gaps which extend in a direction transverse to the material web and by which cutting devices moving, respectively, through the material web are received. Thus, new straight-cut web starts of the material web to be reintroduced can be produced, which can be connected in a simple manner to the web infeed segment suspended stationarily on the suspension station. The movable part of the suspension element is provided with stop faces, because the movable part is formed as a flat, flexible and easily deformable structural part. By providing stop faces on the flat movable part of the web infeed device, a risk of injury to the pressmen is, as much as possible, ruled out. In order to ensure optimum flexibility of the movable part of the web infeed device, the flat movable part is pierced with a multiplicity of orifices in the form of bores which allow easy deformability of the movable part and, together therewith, easy adaptability to the deflection points of the web infeed path for introducing the material web into the rotary printing machine.

The web infeed device, proposed according to the invention, for web-processing rotary printing machines can be used preferably on those rotary printing machines which process material webs on both sides or on one side in job printing or news printing.

Other features which are considered as characteristic for the invention are set forth in the appended claims.

Although the invention is illustrated and described herein as embodied in a web infeed device with decentrally arranged connection stations, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIGS. 3.1 and 3.2 are enlarged fragmentary details thereof;

FIG. 6 is a top plan view of a movable part of a web infeed device with a suspension element mounted on a widened bracket of the movable part; FIGS. 7.1 and 7.2 are fragmentary details thereof.

DESCRIPTION OF THE PREFERRED EMBODIMENTS

Figure 1:
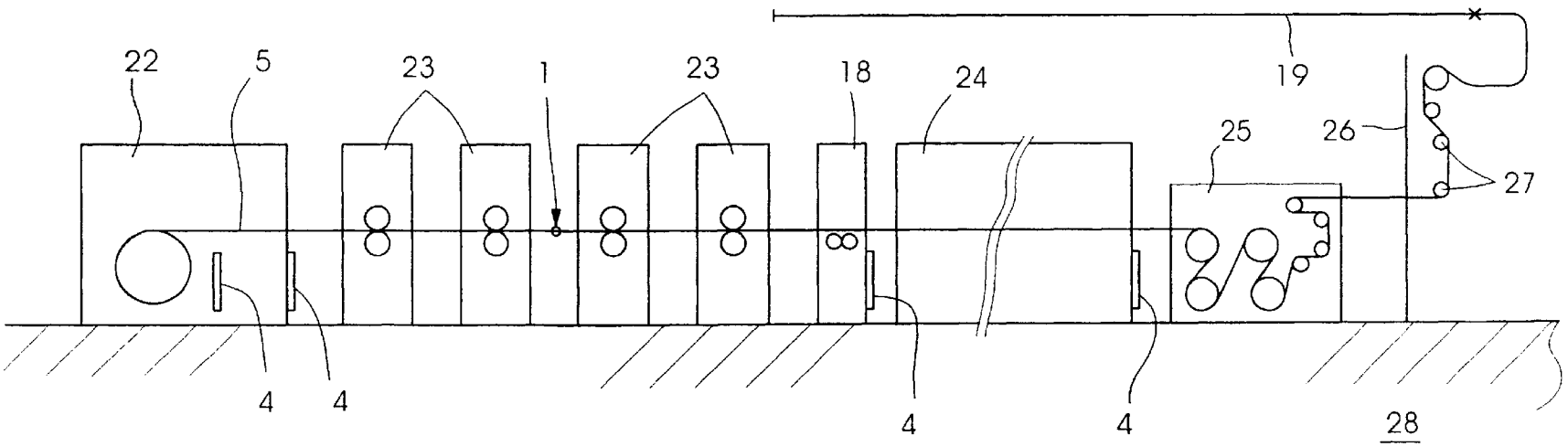
FIG. 1 is a diagrammatic side elevational view of a web-processing rotary printing machine with components which make up the rotary printing machine, such as a web splicer, printing units, a web infeed device, a dryer, a chill-roller section, and a superstructure.

Referring now to the drawings and, first, particularly to FIG. 1 thereof, there is shown therein diagrammatically, components of a web-processing rotary printing machine. A material web 5, starting from a web splicer 22, is printed on one or both sides thereof within one or more printing units 23 of a rotary printing machine, located downline from the web splicer 22, then, after passing through the one or more printing units 23, it passes through a web catching device 18. The web catching device 18 is provided at the front side of a dryer 24, downline from which a chill-roller section 25 is located which includes a number of chill rollers, over which the freshly printed material web revolves after it has passed the dryer, and before the web, which has been printed on one side or on both sides, runs onto web guide rollers 27 of a superstructure 26. After passing the superstructure 26, which is highly diagrammatically reproduced here, the material web, which may be printed on both sides and which may also be cut lengthwise and guided together again in various configurations in the turning-bar superstructure, runs into a non-illustrated folder wherein individual copies are severed or separated from the web and further processed.

In the diagrammatic view illustrated in FIG. 1 of a web-fed rotary printing machine having the aforementioned components, a suspension station is assigned to the web splicer 22. According to FIG. 1, a suspension station 4 is assigned directly to the material web supply in roll form, while a further suspension station 4 is illustrated at the exit of the web splicer 22. A further suspension station 4 is provided on a web outlet side of the web catching device 18; a suspension device 4 is likewise assigned to the dryer 24 on the material web outlet side thereof. It may also be apparent from FIG. 1 that a movable part of a web infeed device can be moved into a parking position 19 which is arranged so that, when the web-processing rotary printing machine is operating normally, the parking position does not impede the passage of the material web printed on one side or on both sides through the web guide rollers 27 of the turning-bar superstructure 26 downline from which a chill-roller section 25 is located. The components mentioned hereinbefore are mounted on a machine foundation 28.

Figure 2:
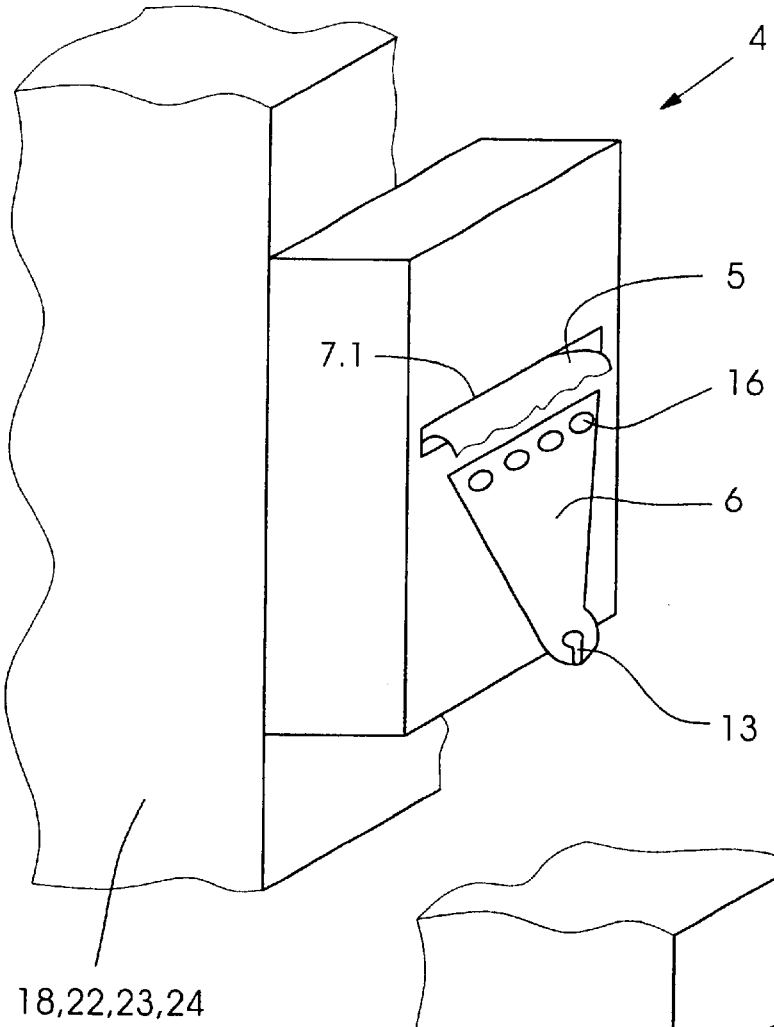
FIG. 2 is a diagrammatic front, side and top perspective view of a suspension station mounted on a component of the rotary printing machine.

FIG. 2 shows diagrammatically a suspension station 4 which can be mounted on a respective side wall of the printing machine components 22, 23, 18 and 24, respectively. According to FIG. 1 which has already been described, the suspension stations 4 are mounted on the material-web outlet sides of the aforementioned components 22, 23, 18 and 24, respectively, of the rotary printing machine. Further shown in FIG. 2 is a suspension segment 6 received on, for example, four knobs 16 located next to one another, below a slot 7.1 out of which there runs the web residue which has remained in the respective component. The suspension segment has a virtually triangular cross section which tapers to a suspension orifice 13 on the front side of the suspension segment 6.

Figure 3:
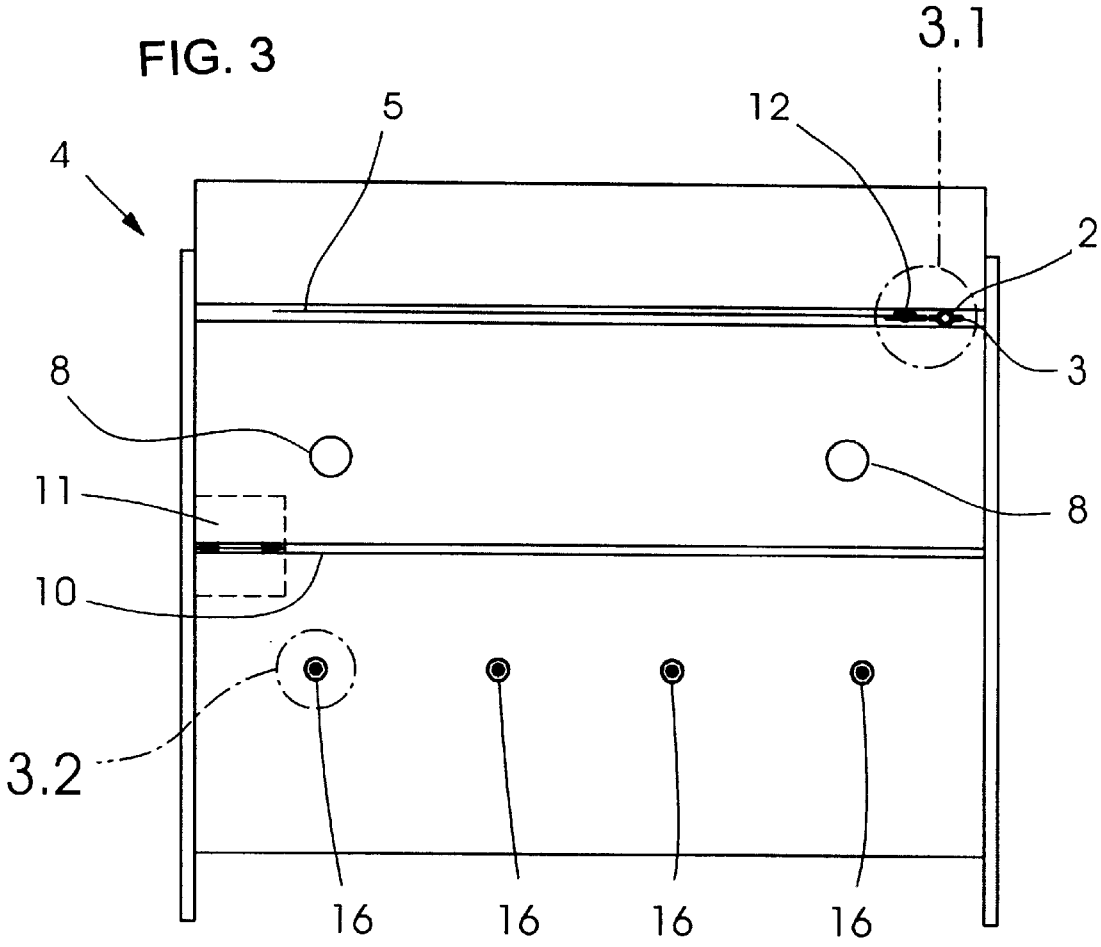
FIG. 3 is a diagrammatic top plan view of a suspension station opposite to the web travel direction.
Figure 3:
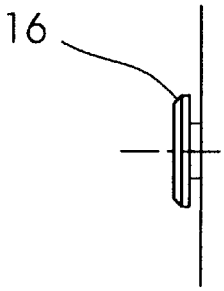
Figure 3:
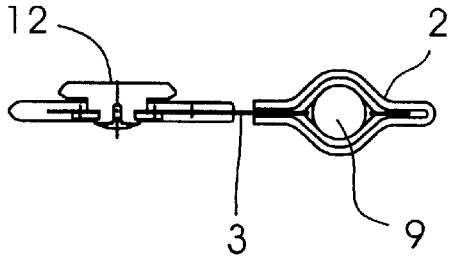

FIG. 3 is a top plan view of the suspension station 4 on each of the components 18, 22, 23 and 24, respectively, of the rotary printing machine.

The suspension device mounted on the web exit side of the printing machine component has, below the holding device 8, a multiplicity of flat knobs 16. The knobs 16 have a widened head which is of extremely flat construction, the suspension segment 6 being suspended therefrom in a downward direction on the suspension station 4. Holding devices 8 are provided above the knob strip which is formed, for example, of four knobs 16. The holding devices 8 may be constructed, for example, as magnets, as a suction strip subjected to a vacuum, as an adhesive tape or adhesive device or else as a hook-shaped holder for receiving thereon the material web residue which has remained in the respective printing machine component. Above the holding devices 8, a slot 7.1, through which the material web 5 passes, extends so as to run over the entire material web width of the material web 5. Provided between the holding devices 8 of the suspension station 4 and the knob strip 16 is a cutting gap 10 which likewise extends transversely to the running or travel direction of the material web 5 and through which an otherwise non-illustrated crosscutting device 11 extends, in order to form a straight-cut web end of the material web 5. As may be gathered from FIG. 3.1 which shows a detail of FIG. 3, the movable part 3, which is formed as an extremely flat metal profile, is received on a guide 2, wherein for example, an axially extending conveying element 9 extends.

It is believed to be apparent from FIG. 3.2 showing a further detail of FIG. 3 that the knobs 16, of which, in the figure, four are mounted next to one another with equal mutual spacing below the gap 10, have a flat and relatively large head.

Figure 4:
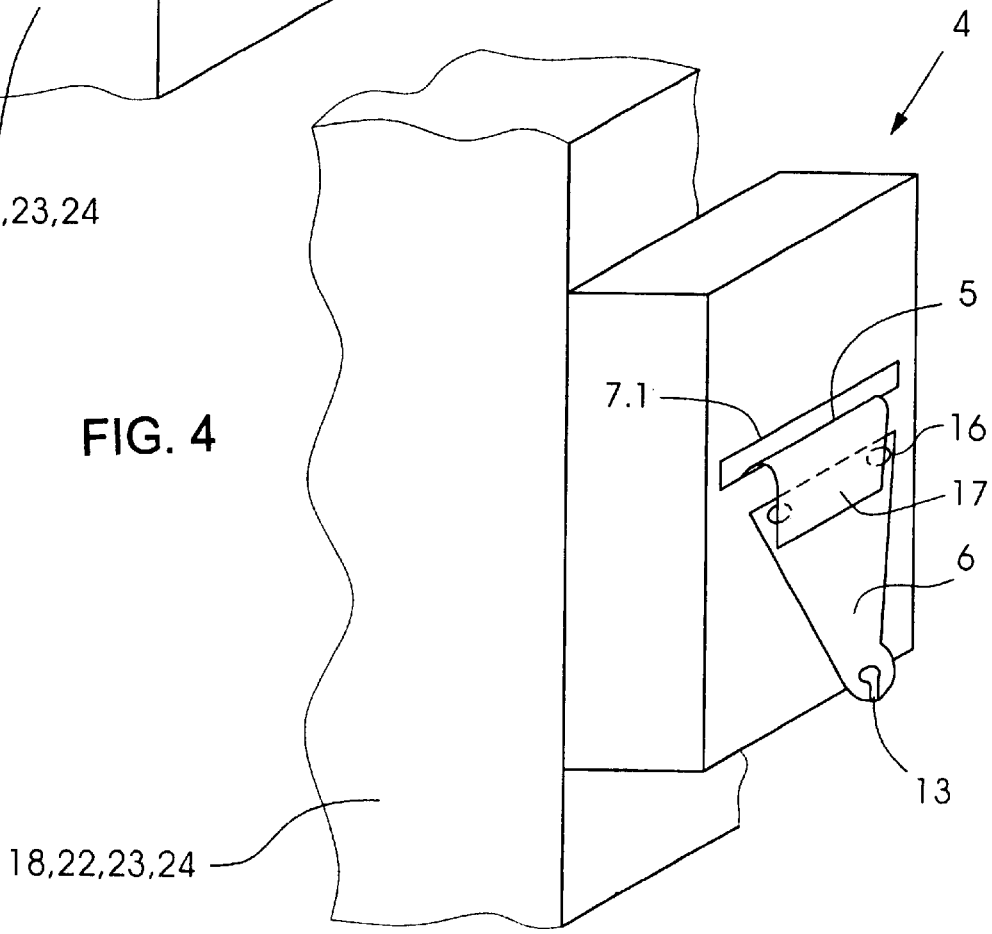
FIG. 4 is a view similar to that of FIG. 2 of a suspension station mounted on a component of the rotary printing machine, with a suspension segment suspended from the component and already connected to the web.
Figure 5:
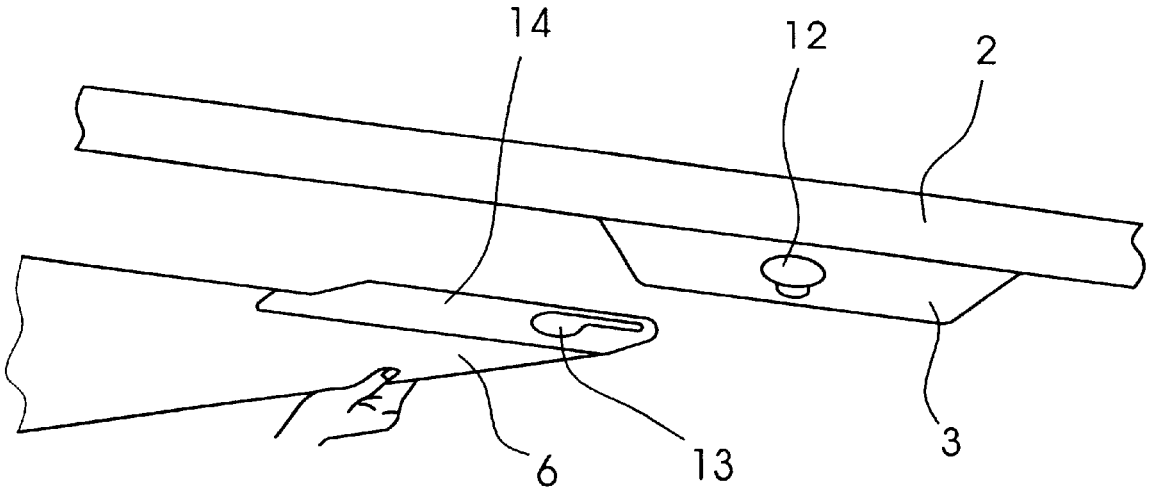
FIG. 5 is a perspective vie of a suspension segment suspended from a movable part of a web infeed device.

It is believed to be apparent from FIG. 4 as to how a material web start extending through the slot 7.1 is connected by an adhesive tape to the rear side of the infeed segment 6 which is still held on the knobs 16 of the suspension station 4. In order to introduce the web start of the material web 5, the web start being connected to the rear side of the suspension segment 6, according to FIG. 5 the pressman merely has to suspend in the suspension knob 12 of the movable part 3 the suspension segment 6 which is provided with a suspension orifice 13 extending in the longitudinal direction and being formed with a bulge or bay. The movable part 3 is surrounded, along the path of introduction of the material web 5, by a guide profile 2 which may extend in tubular form or in the form of a U-profile or in some other geometric configuration along the web introduction path through the components of the rotary printing machine. Instead of the configuration, illustrated here, of the suspension orifice 13 and of the suspension head 12 on the movable part 3, other different constructions of a connection of the components 13 and 12 may also be visualized, for example touch-and-close fastenings, adhesive tape connections or the like. The suspension orifice 13 with the bulge or bay is formed in a reinforced suspension bracket 14. The suspension bracket 14 is fastened to the front side of the suspension segment 6 in the region of the tip of the triangular suspension segment 6, being either interwoven with the latter, adhesively bonded thereto or fastened thereto in any other manner.

It is believed to be apparent from the top view of the movable part according to FIG. 6 of the web infeed device according to the invention that the movable part 3 may be provided, along the longitudinal extent thereof, with a plurality of bores in the region of the guide 2 and with a further plurality of orifices 20 in the region of the suspension part. Bumpers 21 are fastened to the flat bracket of the movable part 3 in the region of the suspension knob 12, in order to reduce the risk of injury to the pressman who is performing the suspension of the suspension segment 6 on the suspension knob 12. Due to the multiplicity of orifices 20 which are preferably constructed as bores in the movable part 3, the latter is given particular flexibility and particular deformability during movement past extreme deflections in the region of the path of introduction of the material web 5 through the components of the rotary printing machine. The orifices 20 in the movable part give the latter extreme flexibility, considerably reduce the tendency thereof to buckling and make it possible to reduce the drive power to be provided for driving the infeed element formed of the movable part 3 and the suspension segment 6. Furthermore, the friction between the guide 2 and the movable part 3 is appreciably reduced as a result of the easy deformability of the movable part 3 in the guide 2 thereof. It is believed to be apparent from FIG. 6.1 which is a detail of FIG. 6 that the movable part 3 is connected in the form of a thin metal profile to a web conveying element extending in the axial direction and constructed, for example, as a pull rope. According to FIG. 6.1, the suspension knob 12 is surrounded by the bumpers 21, so that the risk of injury to the pressman by the flat metal profile of the movable part 3 is considerably reduced. Instead of a metallic material, the movable part 3 may also be produced from a plastic material which has extreme inherent flexibility, in order, on the one hand, to reduce the friction in the guide element in the guide and, on the other hand, permanently to withstand the extreme deflections occurring along the introduction path and the accompanying deformations of the movable part.

Figure 7:
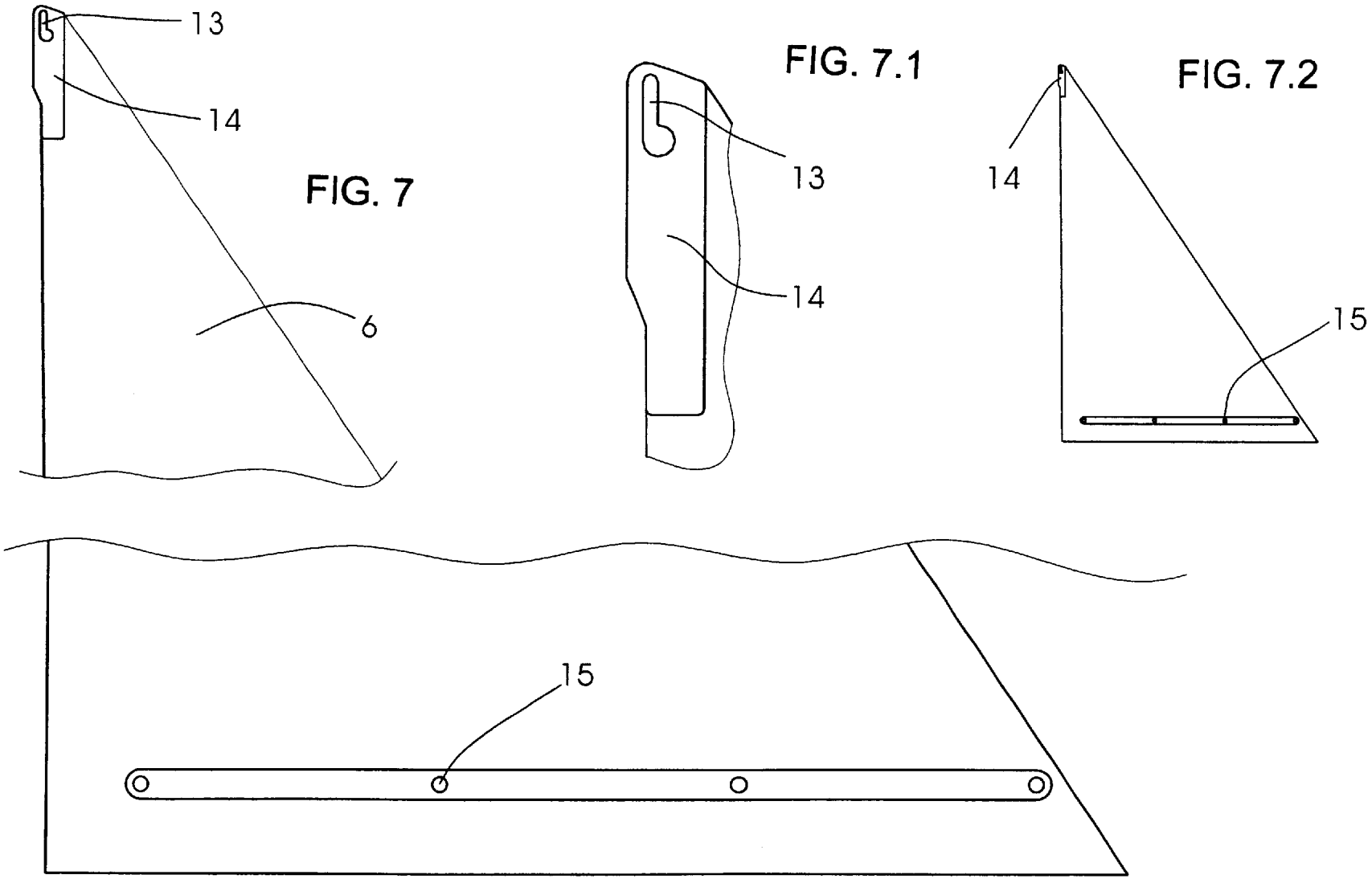
FIG. 7 is a top plan view of the web infeed segment mounted stationarily on the suspension station.

FIG. 7 shows in more detail the configuration of the suspension segment 6 received stationarily on the suspension stations 4.

In particular, it can be seen from FIG. 7 that the suspension bracket 14 is received at the tip of the virtually triangular suspension segment 6. In the suspension bracket 14, the suspension orifice 13 can be seen formed as a long hole or slot with a bulge or bay, and extending towards the tip of the suspension segment 6. After the suspension head has entered the movable part 3 during the suspension operation, the orifice has the shank of the suspension head 12 passing through it and makes a connection, which absorbs tensile forces, between the movable part 3 and the suspension segment 6 making up the suspension element.

Formed on the wide side of the triangular suspension segment 6, which is illustrated here in section, are a plurality of suspension orifices 15, by which the suspension segment 6, which is received stationarily on the suspension stations 4, can be suspended on the suspension devices 16 of the respective suspension station 4. The detail of FIG. 7 illustrated in FIG. 7.1 shows more clearly the configuration of the one orifice 13 formed in the suspension bracket 14. The suspension bracket 14 on the suspension segment 6, which again may be formed of plastic material, may have a metallic reinforcement, so that wear resistance of the edges of the one orifice 13 is afforded permanently and the latter does not have to be exchanged prematurely. The suspension bracket 14 may either be adhesively bonded, welded, screwed or riveted to the material of the suspension segment 6 or may be mechanically or materially and positively connected to the tip of the suspension segment 6 in any other manner.

The configuration of the virtually triangular suspension segment 6 of FIG. 7 is believed to be apparent from the detail thereof shown in FIG. 7.2. In a preferred embodiment of the suspension segment 6, the latter is not an isosceles triangle, but a right-angled triangle, the longer leg of which is oriented parallel to the running or travel direction of the material web 5. A multiplicity of suspension orifices 15 are formed on the shorter leg, while the hypotenuse of the right-angled triangle is formed without additional components. In another embodiment of a connection between a newly formed web start of a material web 5 and the rear side of the suspension segment 6, for example, an adhesive tape may be used, which has sufficient resistance to the heat generated in the dryer 24 of the rotary printing machine, so that the adhesive connection between the suspension segment 6 and the newly formed material web start remains ensured during passage thereof through the dryer 24 of the rotary printing machine.

We claim:

1. A device for infeeding a material web into a rotary printing machine with a plurality of components the device comprising:

a guide extending at least approximately parallel to a path of the material web through the components of the rotary printing machine;

an infeed element for receiving a material web start, said infeed element to be introduced into said guide; and a plurality of suspension stations, the material web to be connected to said infeed element at said suspension stations;

said plurality of suspension stations being decentrally disposed along the path of the material web, and each of said suspension stations being provided on a respective one of the plurality of components.

2. The device according to claim 1, wherein said suspension stations are arranged below the path of the material web through the rotary printing machine.

3. The device according to claim 1, wherein said suspension stations include a cutting device movable transversely to the material web in a cutting gap.

4. The device according to claim 1, wherein said plurality of suspension stations each include a suspension segment to be mounted thereon and said infeed element includes a movable part movable in said guide.

5. The device according to claim 4, wherein said suspension segment is suspended from said movable part.

6. The device according to claim 4, wherein said movable part is equipped with stop faces.

7. The device according to claim 4, wherein said movable part of said infeed element is mounted in a parking position.

8. The device according to claim 7, wherein said movable part is formed of a flat and flexible metal profile.

9. The device according to claim 8, wherein orifices conducive to the deformability of said movable part of said infeed element are formed in said movable part.

10. The device according to claim 4, including holding devices for said suspension segments provided on said suspension stations.

11. The device according to claim 10, wherein said holding devices are formed as magnets.

12. The device according to claim 10, wherein said holding devices are formed as suction strips subjectible to a vacuum.

13. The device according to claim 10, wherein said holding devices are formed as adhesive stations.

14. The device according to claim 10, wherein said holding devices are formed as hook-shaped holders.

15. The device according to claim 10, wherein said suspension segments are mountable stationarily on said holding devices.

16. A web rotary printing machine with a plurality of components and with a device for infeeding a material web, the device comprising:

a guide extending at least approximately parallel to a path of the material web through the components of the rotary printing machine;

an infeed element for receiving a material web start, said infeed element to be introduced into said guide; and a plurality of suspension stations the material web to be connected to said infeed element at said suspension stations;

a plurality of suspension stations being decentrally disposed along the path of the material web, and each of said suspension stations being provided on a respective one of the plurality of components.

* * * * *